US010233712B2

(12) United States Patent
Nguyen et al.

(10) Patent No.: US 10,233,712 B2
(45) Date of Patent: Mar. 19, 2019

(54) ONE-TRIP HANGER RUNNING TOOL

(71) Applicant: Cameron International Corporation, Houston, TX (US)

(72) Inventors: Dennis P. Nguyen, Pearland, TX (US); Kythu Nguyen, Friendswood, TX (US)

(73) Assignee: Cameron International Corporation, Houston, TX (US)

( * ) Notice: Subject to any disclaimer, the term of this patent is extended or adjusted under 35 U.S.C. 154(b) by 94 days.

(21) Appl. No.: 15/375,073

(22) Filed: Dec. 9, 2016

(65) Prior Publication Data

US 2018/0163491 A1 Jun. 14, 2018

(51) Int. Cl.
*E21B 33/04* (2006.01)

(52) U.S. Cl.
CPC ..... *E21B 33/04* (2013.01)

(58) Field of Classification Search
CPC ..... E21B 23/02; E21B 33/0415; E21B 23/01; E21B 33/04
See application file for complete search history.

(56) References Cited

U.S. PATENT DOCUMENTS

2004/0200320 A1* 10/2004 Knopp ..... B23D 29/005 81/57.39
2011/0253389 A1* 10/2011 Nguyen ..... E21B 33/04 166/382
2015/0027738 A1* 1/2015 Nguyen ..... E21B 33/035 166/382
2016/0186523 A1* 6/2016 Nguyen ..... E21B 33/0415 166/382

* cited by examiner

*Primary Examiner* — Cathleen R Hutchins
(74) *Attorney, Agent, or Firm* — Fletcher Yoder, P.C.

(57) ABSTRACT

A system includes a hanger running tool that has a tool body, a first sleeve coupled to an external surface of the tool body, a second sleeve coupled to the first sleeve, where the second sleeve is configured to engage a push ring of a hanger to drive a lock ring of the hanger into a recess of a casing spool, and a pin disposed in the tool body and the first sleeve, where the pin is configured to enable rotation of the tool body independent of the first sleeve in a first circumferential direction, and where the pin is configured to block rotation of the tool body independent of the first sleeve in a second circumferential direction, opposite the first circumferential direction.

20 Claims, 12 Drawing Sheets

ONE-TRIP HANGER RUNNING TOOL

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems generally include a wellhead assembly through which the resource is extracted. These wellhead assemblies may include a wide variety of components and/or conduits, such as blowout preventers (BOPs), as well as various control lines, casings, valves, and the like, that control drilling and/or extraction operations. Hangers (e.g., tubing hangers or casing hangers) may be used to support sections or strings of casing or tubing within a wellhead assembly. Hangers are typically installed by a tool (e.g., a hanger running tool) in multiple trips by the tool. Unfortunately, each trip by the tool increases the time and costs associated with installation of the hanger.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The presently disclosed embodiments include a mechanically actuated hanger running tool and hanger that is configured to install the hanger within a wellhead assembly in a single trip. Installing the hanger in a single trip reduces the time and cost associated with assembling and/or operating a mineral extraction system. Specifically, in the disclosed embodiments, the hanger running tool may be secured to the hanger on a rig platform. The running tool and hanger assembly may be directed into a wellbore, such that the hanger rests on a shoulder and/or lip of a wellhead component (e.g., a casing spool). To secure the hanger to the wellhead component (e.g., a casing spool), a first force (e.g., a first rotational force or a first circumferential force) may be applied to the hanger running tool to actuate a lock ring of the hanger, which may secure the hanger to the wellhead component. Subsequently, the hanger running tool may preload the lock ring and decouple from the hanger upon application of a second force (e.g., a second rotational force or a second circumferential force) to the hanger running tool. Releasing the hanger running tool from the hanger (e.g., the running tool may be unthreaded from the hanger) may occur while the lock ring between the hanger and the wellhead component remains in place. Accordingly, the running tool may be retrieved from the wellhead assembly and the hanger may be secured to the wellhead component.

Figure 1:
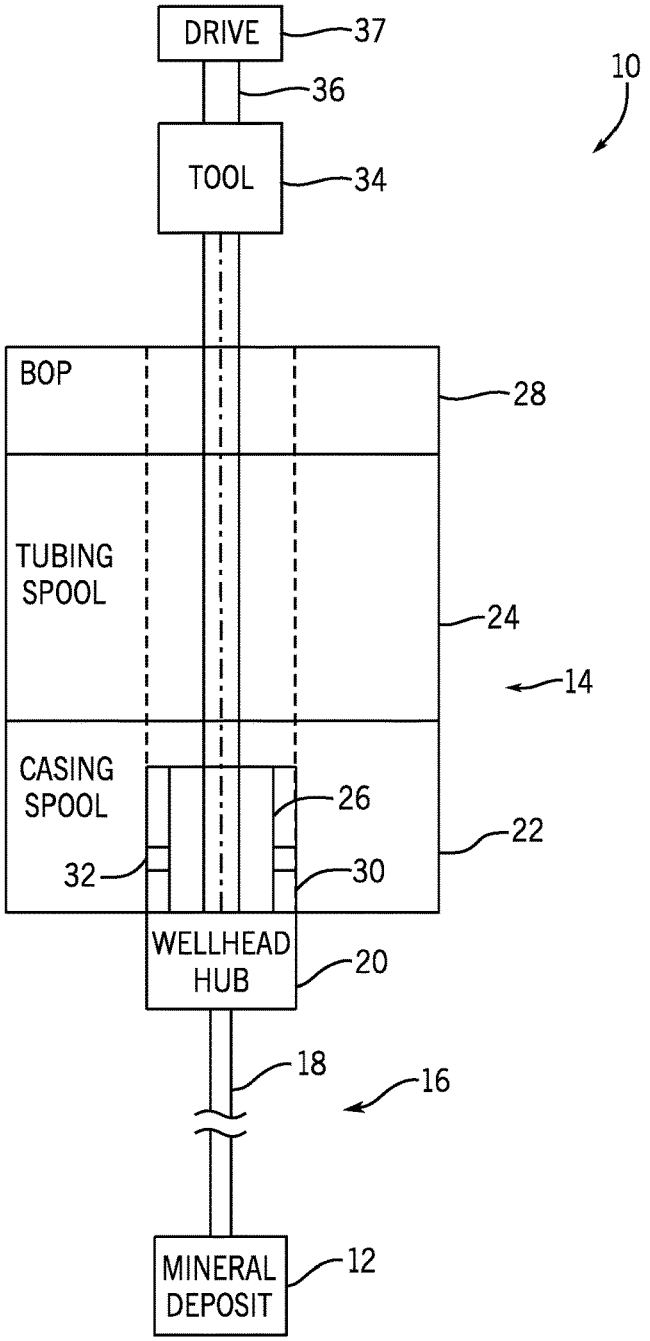
FIG. 1 is a schematic of an embodiment of a mineral extraction system that may utilize an enhanced hanger running tool, in accordance with an aspect of the present disclosure.

FIG. 1 is a schematic of a mineral extraction system 10 (e.g., hydrocarbon extraction system) configured to extract various natural resources, including hydrocarbons (e.g., oil and/or natural gas), from a mineral deposit 12. Depending upon where the natural resource is located, the mineral extraction system 10 may be land-based (e.g., a surface system) or subsea (e.g., a subsea system). The illustrated system 10 includes a wellhead assembly 14 coupled to the mineral deposit 12 or reservoir via a well 16. Specifically, a well bore 18 extends from the mineral deposit 12 (e.g., a reservoir) to a wellhead hub 20 located at or near the surface.

The illustrated wellhead hub 20, which may be a large diameter hub, acts as an early junction between the well 16 and the equipment located above the well 16. The wellhead hub 20 may include a complementary connector, such as a collet connector, to facilitate connections with the surface equipment. The wellhead hub 20 may be configured to support various strings of casing or tubing that extend into the wellbore 18, and in some cases extending down to the mineral deposit 12.

The wellhead 14 generally includes a series of devices and components that control and regulate activities and conditions associated with the well 16. For example, the wellhead 14 may provide for routing the flow of produced minerals from the mineral deposit 12 and the well bore 18, provide for regulating pressure in the well 16, and provide for the injection of chemicals into the well bore 18 (downhole). In the illustrated embodiment, the wellhead 14 includes a casing spool 22 (e.g., tubular), a tubing spool 24 (e.g., tubular), a hanger 26 (e.g., a tubing hanger or a casing hanger), and a blowout preventer (BOP) 28.

In operation, the wellhead 14 enables completion and workover procedures, such as tool insertion into the well 16 for installation and removal of various components (e.g., hangers, shoulders, etc.). Further, minerals extracted from the well 16 (e.g., oil and natural gas) may be regulated and routed via the wellhead 14. For example, the blowout preventer (BOP) 28 may include a variety of valves, fittings, and controls to prevent oil, gas, or other fluid from exiting the well 16 in the event of an unintentional release of pressure or an overpressure condition.

As illustrated, the casing spool 22 defines a bore 30 that enables fluid communication between the wellhead 14 and the well 16. Thus, the casing spool bore 30 may provide access to the well bore 18 for various completion and workover procedures, such as disposing tools or components within the casing spool 22. To dispose the components in the casing spool 22, a shoulder 32 provides a temporary or permanent landing surface that can support pieces of equipment (e.g., hangers). For example, the illustrated embodiment of the extraction system 10 includes a tool 34 suspended from a drill string 36. In certain embodiments, the tool 34 may include running tools (e.g., hanger running tools, shoulder running tools, slip tools, etc.) that are lowered (e.g., run) toward the well 16, the wellhead 14, and the like. Further, the tool 34 may be driven to move (e.g., axially or circumferentially) by a drive 37 that applies a torque or force to the tool 34 in order to install the hanger 26 in the casing spool 22, for example. The hanger 26 may be installed on the shoulder 32 and used to support sections of casing or tubing within the wellhead assembly 14. In some cases, it may be desirable to couple the hanger 26 to the casing spool 22 (e.g., to install tubing). However, typical hanger running tools and hangers may take multiple trips to couple the hanger 26 to the casing spool 22 and to remove the hanger running tool from the wellhead 14.

Figure 2:
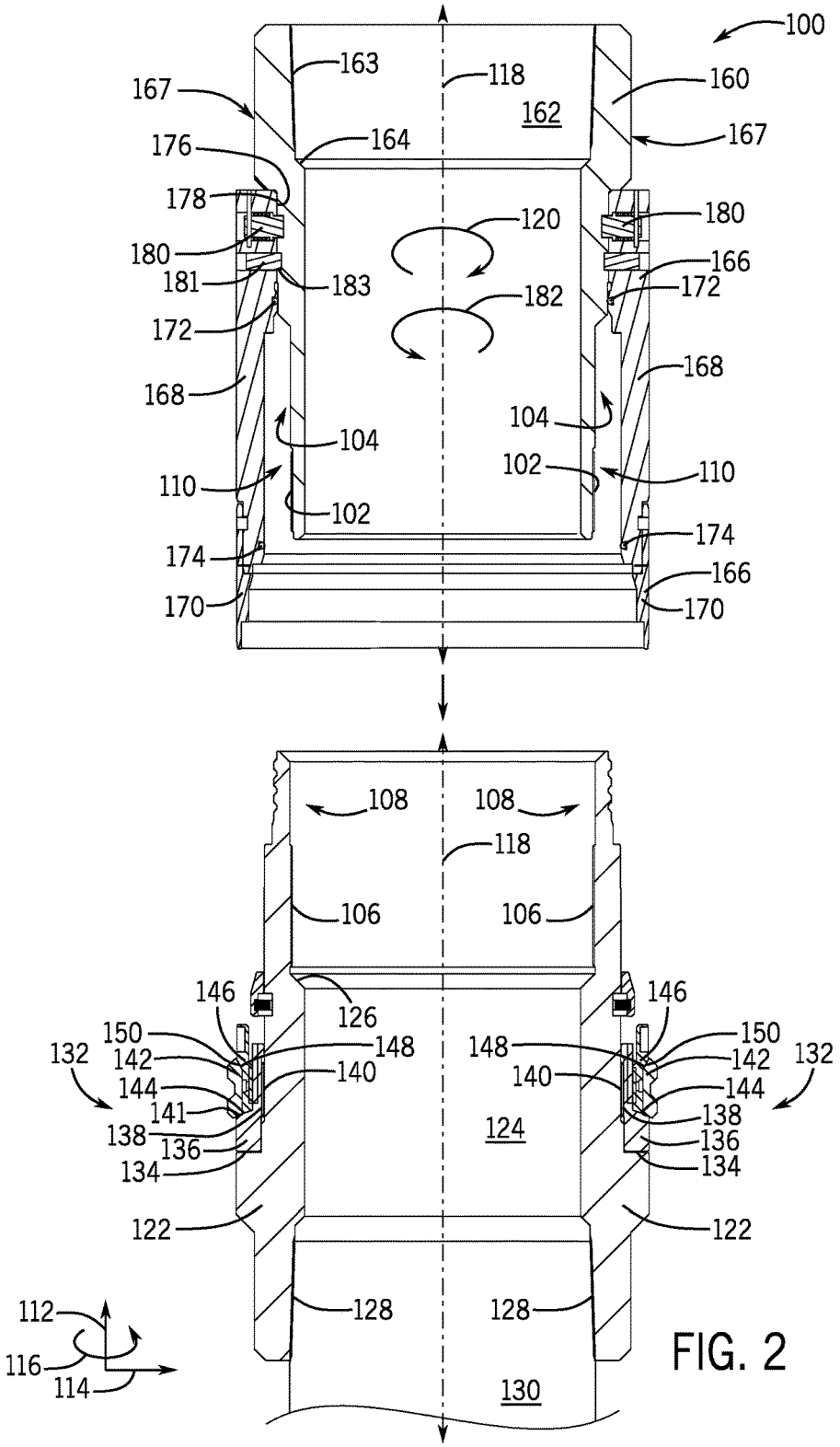
FIG. 2 is a side cross-section view of a hanger running tool and a hanger before the hanger running tool and the hanger are coupled to one another, in accordance with an aspect of the present disclosure.

Accordingly, embodiments of the present disclosure relate to an enhanced hanger running tool 100 and hanger 26 that may lock the hanger 26 to the casing spool 26, preload the hanger 26, and remove the hanger running tool 100 in a single trip. For example, FIG. 2 is a side, section view of the hanger running tool 100 being coupled to the hanger 26 for installation in the wellhead 14. In some embodiments, the hanger running tool 100 is coupled to the hanger 26 before the hanger running tool 100 is inserted into the wellhead assembly 14. For example, the hanger running tool 100 may be coupled to the hanger 26 on the rig floor. The hanger running tool 100 may include threads 102 (e.g., external or male threads) on an outer annular surface 104 and the hanger 26 may include corresponding threads 106 (e.g., internal or female threads) on an inner annular surface 108, such that the hanger 26 may be disposed in an annular opening 110 of the hanger running tool 100 and secured to the hanger running tool 100 via the threads 102 and 106. For reference, a coordinate system is shown comprising an axial direction or axis 112, a radial direction or axis 114, and a circumferential direction or axis 116 relative to a central axis 118 of the hanger running tool 100 and/or the hanger 26. In some embodiments, the hanger running tool 100 may be rotated in a first circumferential direction 120 about the central axis 118 to secure the hanger running tool 100 to the hanger 26 (e.g., to mesh the threads 102 and 106 to one another).

As shown in the illustrated embodiment of FIG. 2, the hanger 26 includes a generally annular body 122, which defines a bore 124, an upper tapered annular shoulder 126 (e.g., conical shoulder), and a lower mounting interface 128 (e.g., internal threaded interface or female threads), which may be used to hang a tubular 130. Proximate an axial end 132 (e.g., downhole end) of the body 122 is a lip 134 (e.g., a radially protruding annular flange, shoulder, or axial abutment surface). Disposed about the body 122 is an annular preload ring 136. The preload ring 136 has an interior threaded surface 138 (e.g., female threads) that engages with an exterior threaded surface 140 (e.g., male threads) of the body 122 to secure the preload ring 136 in place relative to the body 122. Additionally, a lock ring 142 (e.g., an annular lock ring) may be disposed about the body 122 and the preload ring 136, and an inward tapered interior surface 141 (e.g., energizing taper portion) of the lock ring 142 may rest upon an inward tapered exterior surface or lip 144 (e.g., a radially protruding annular lip, tapered surface, or energizing taper portion) of the preload ring 136.

Additionally, a push ring 146 may be disposed about the body 122. The push ring 146 may have an inward tapered exterior surface 148 (e.g., energizing taper portion) that interfaces with an inward tapered interior surface 150 (e.g., energizing taper portion) of the lock ring 142. The surfaces 141, 144, 148, and 150 may be tapered annular surfaces (e.g., conical surfaces) that are acutely angled relative to the radial axis 114 and/or the axial axis 112. When the push ring 146 moves in the axial direction 112 toward the lock ring 142, the lock ring 142 may expand radially outward (e.g., toward a surface of the wellhead 14) as the tapered surface 148 of the push ring 146 engages the tapered surface 150 of the lock ring 142 and the tapered surface 144 of the preload ring 136 engages the tapered surface 141 of the lock ring 142. Correspondingly, when the push ring 146 moves in the axial direction 112 away from the lock ring 142, the lock ring 142 may radially contract (e.g., away from the surface of the wellhead 14). In some embodiments, angles of each of the tapered surfaces 141, 144, 148, and/or 150 may be substantially the same to create symmetry, thereby enabling an equally distributed force to be applied along a circumference of the lock ring 142. However, in other embodiments, the angles of each of the tapered surfaces 141, 144, 148, and/or 150 may be different from one another. The tapered surfaces 141, 144, 148, and/or 150 may include an angle between 45 and 150 degrees, between 50 and 140 degrees, and/or between 60 and 125 degrees. In other embodiments, the tapered surfaces 141, 144, 148, and/or 150 may include any suitable angle to facilitate movement of the lock ring 142 radially outward toward the casing spool 22.

The hanger running tool 100 includes an annular body 160, which defines a bore 162. In some embodiments, the body 160 includes a shoulder 164 (e.g., tapered annular shoulder or conical surface) facing in the axial downward direction 112, which may be configured to facilitate coupling of additional components to the annular body 160. Additionally or alternatively, the body 160 may include threads 163 (e.g., female threads) for coupling the body 160 to a string (e.g., a tubular string). Furthermore, the body 160 may be coupled to one or more push members 166 (e.g., linkages, rods, annular sleeves, or elongated structures), which may be used to actuate the push ring 146 and lock ring 142 of the hanger 26. In certain embodiments, the push members 166 include one or more sleeves disposed about an external surface 167 of the body 160. For example, the push members 166 may include a first sleeve 168 (e.g., a first annular sleeve and/or another suitable push member) that is disposed about the annular body 160 (e.g., coupled to the external surface 167 of the body 160). In some embodiments, a second sleeve 170 (e.g., a second annular sleeve and/or another suitable push member) may be coupled to the first sleeve 168 and/or to the body 160. The first sleeve 168 and/or the second sleeve 170 may be configured to contact one or more components of the hanger 26 and to apply an axial force on the push ring 146 and/or the lock ring 142 to couple the hanger to the wellhead 14.

In some embodiments, a first seal 172 (e.g., an annular seal) may be disposed between the body 160 and the first sleeve 168 to form a seal between the body 160 and the first sleeve 168, such that a flow of fluid between the body 160 and the first sleeve 168 is substantially blocked. Additionally, a second seal 174 (e.g., an annular seal) may be disposed between the first sleeve 168 and the hanger 26 (e.g., when the hanger 26 is disposed in the opening 110) to form a seal between the first sleeve 168 and the hanger 26, such that a flow of fluid between the first sleeve 168 and the hanger 26 is substantially blocked.

In some embodiments, the first sleeve 168 may be coupled to the body 160 by one or more pins 181 (e.g., pins spaced about the first sleeve 168 and the body 160 or a ring) disposed in an annular groove or slot 183 of the body 160. Additionally, the body 160 may include one or more pins 180 (e.g., one, two, three, four, five, six, seven, eight, nine, ten, or more pins 180) that block rotation of the body 160 in a second circumferential direction 182 about the central axis 118, opposite the first circumferential direction 120, with respect to the first sleeve 168 (e.g., the body 160 does not rotate independent of the first sleeve 168). In some embodiments, the one or more pins 180 may be uniformly spaced about the first sleeve 168 and the body 160 of the hanger running tool 100. In other embodiments, the one or more pins 180 may be non-uniformly spaced about the first sleeve 168 and the body 160. As described in detail below with reference to FIG. 8, each pin 180 may include a tapered surface that facilitates rotation of the body 160 in the first circumferential direction 120 about the central axis 118 with respect to the first sleeve 168. Additionally, each pin 180 may include a second surface that substantially blocks rotation of the body 160 with respect to the first sleeve 168 in the second circumferential direction 182. In some embodiments, the second surface of the pin 180 may be substantially parallel to the external surface 167 of the body 160, and the tapered surface may form an angle with the second surface that facilitates rotation in the first circumferential direction 120. For example, the angle may be between 30 and 70 degrees, between 40 and 50 degrees, or between 43 and 47 degrees. In other embodiments, the angle may be approximately (e.g., within 5% or within 10%) 45 degrees.

As discussed above, the hanger running tool 100 may be coupled to the hanger 26 on a rig platform or surface by disposing the hanger 26 into the annular opening 110 of the hanger running tool 100. The hanger running tool 100 may rotate in the first circumferential direction 120 with respect to the hanger 26 to mesh the threads 102 and 106 with one another and secure the hanger running tool 100 to the hanger 26. In some embodiments, the hanger running tool 100 may be partially coupled to the hanger 26, such that the threads 102 do not extend a full length of the threads 106. Accordingly, the hanger running tool 100 may still move in the axial direction 112 when rotated in the first circumferential direction 120 after the hanger running tool 100 and the hanger 26 are disposed in the well 16. For example, the hanger running tool 100 and/or the hanger 26 may include a stop and/or another indicator, such that the hanger running tool 100 and the hanger 26 may be sufficiently coupled to one another (e.g., threaded) before being disposed into the well 16, but without driving the lock ring 142. Accordingly, when the hanger running tool 100 rotates in the first circumferential axis 120 in the well 16, the body 160 may rotate independent of the first sleeve 168 and/or the second sleeve 170 (e.g., the first sleeve 168 and/or the second sleeve 170 may not rotate with the body 160) and drive the first sleeve 168 and/or the second sleeve 170 in the axial direction 112.

Figure 3:
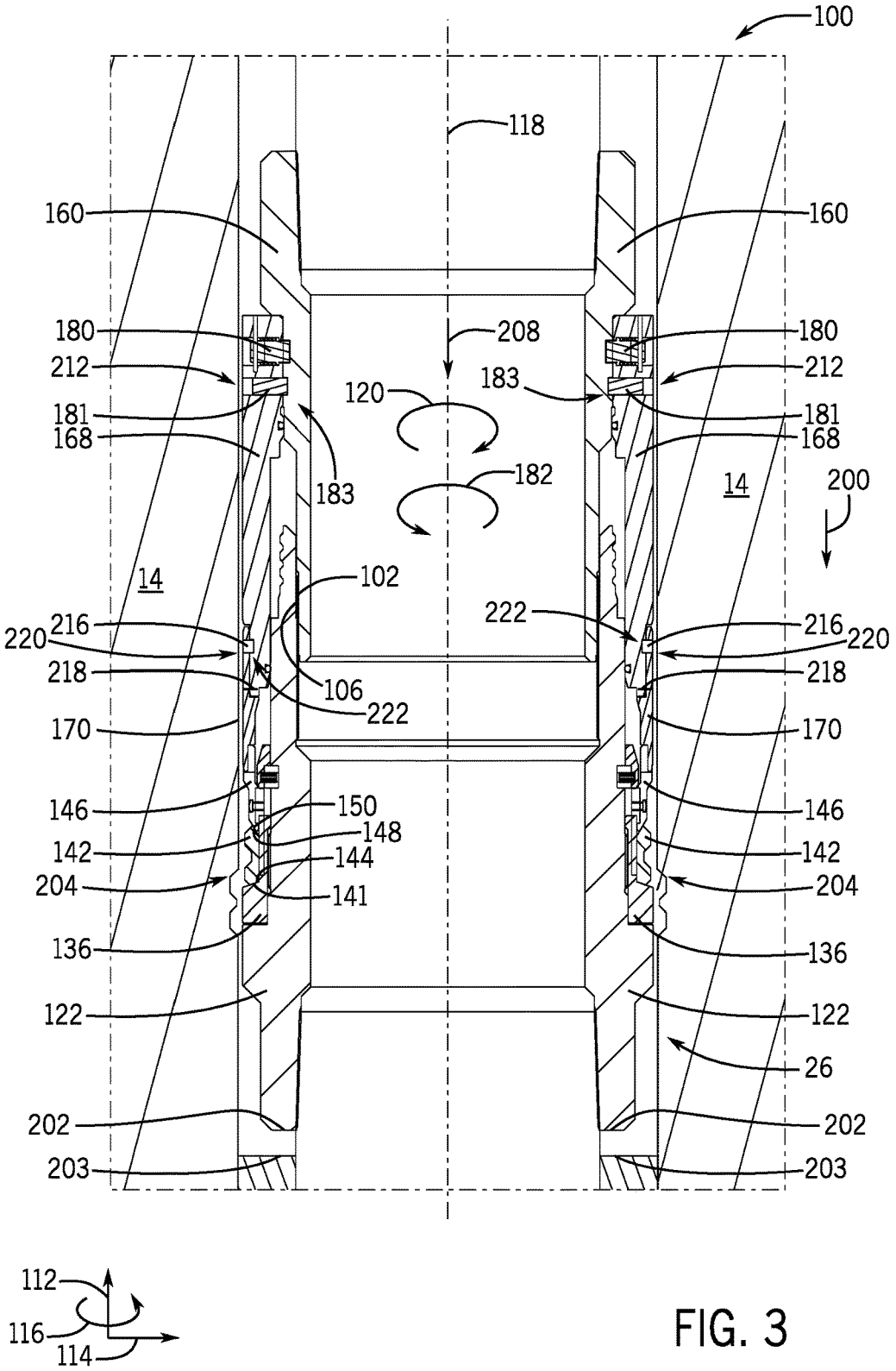
FIG. 3 is a side cross-section view of the hanger running tool and the hanger of FIG. 2 coupled to one another and a lock ring of the hanger in an unlocked position, in accordance with an aspect of the present disclosure.

FIG. 3 is a side, section view of the hanger running tool 100 disposed over and about the hanger 26 such that the body 160 of the hanger running tool 100 is disposed over the body 122 of the hanger 26. As discussed above, the threads 102 and 106 may secure the hanger running tool 100 to the hanger 26. Additionally, FIG. 3 shows the hanger running tool 100 and hanger 26 inserted into a wellhead assembly 14. As shown, the hanger running tool 100 and hanger 26 are inserted into the well head assembly 14 in the axial direction 112, as indicated by arrow 200, until a lip 202 of the hanger 26 lands on a matching shoulder 203 (e.g., tapered annular landing shoulder) of the casing spool 22.

Figure 4:
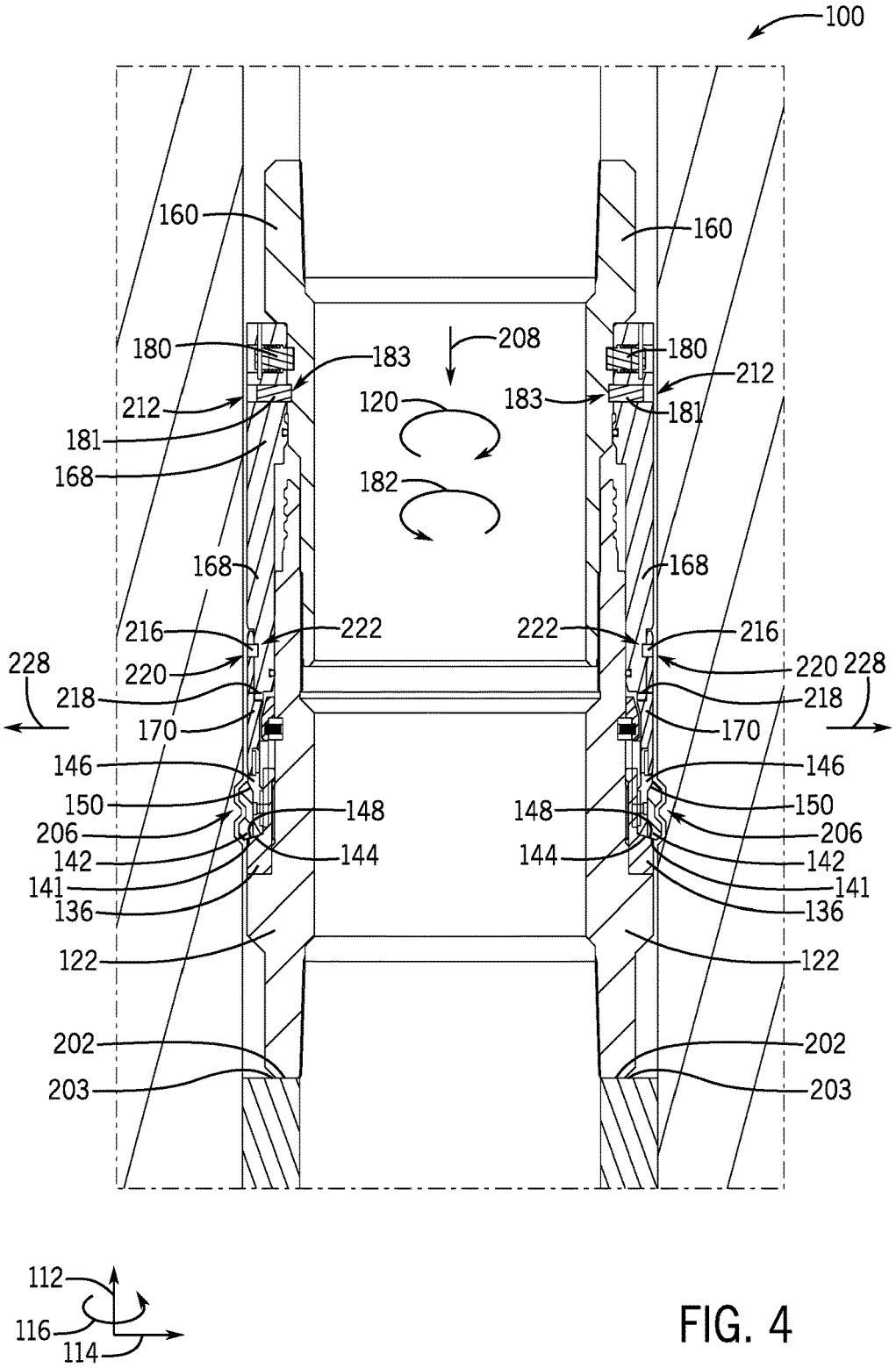
FIG. 4 is a side cross-section view of the lock ring of the hanger of FIG. 3 in a locked position, in accordance with an aspect of the present disclosure.

When the lip 202 of the hanger 26 lands on the shoulder 203, the hanger 26 may be installed by actuating the lock ring 142. FIG. 3 is a side, section view illustrating an unlocked position 204 of the lock ring 142, whereas FIG. 4 is a side, section view illustrating a locked position 206 of the lock ring 142. To move the lock ring 142 from the unlocked position 204 (e.g., a default position) to the locked position 206, the hanger running tool 100 may be rotated in the first circumferential direction 120. Rotation of the hanger running tool 100 in the first circumferential direction 120 may drive rotation of the body 160 of the hanger running tool 100 in the first circumferential direction 120. The threads 102 of the hanger running tool 100 may then further engage with the threads 106 of the hanger 26, thereby driving the hanger running tool 100 in the axial direction 112. Additionally, the one or more pins 180 may enable rotation of the body 160 independent of (e.g., without rotation of) the first sleeve 168 of the hanger running tool 100. Accordingly, the first sleeve 168 (and thus the second sleeve 170) may remain substantially stationary with respect to the circumferential axis 116 (e.g., the first sleeve 168 and the second sleeve 170 do not rotate in the first circumferential direction 120 with the body 160).

As the hanger running tool 100 rotates in the first circumferential direction 120, the body 160 moves in the axial direction 112, as indicated by arrow 208. As described above, the threads 102 of the hanger running tool 100 may further engage with the threads 106 of the hanger 26 as the hanger running tool rotates in the first circumferential direction 120, thereby driving the hanger running tool 100 in the axial direction 112. Movement of the body 160 in the axial direction 112 drives the first sleeve 168 and the second sleeve 170 to move in the axial direction (e.g., as indicated by arrow 208). For example, the one or more pins 181 (e.g., one, two, three, four, five, six, seven, eight, nine, ten, or more pins 181) may couple the body 160 of the hanger running tool 100 to the first sleeve 168. The one or more pins 181 may be disposed in an opening or a slot 212 of the first sleeve 168 and extend into the groove 183 (e.g., annular groove) of the body 160. Accordingly, the body 160 may rotate along the circumferential direction 116 about the central axis 118 independent of the first sleeve 168 (e.g., each coupling pin 181 slides circumferentially along the groove 183 of the body 160), but the first sleeve 168 may be driven in the axial direction 112 by the body 160 because of the one or more pins 181.

Similarly, one or more second coupling pins 216 (e.g., one, two, three, four, five, six, seven, eight, nine, ten, or more pins 216) may secure the second sleeve 170 to the first sleeve 168. The one or more second coupling pins 216 may be uniformly spaced circumferentially about the first sleeve 168 and the second sleeve 170. In other embodiments, the one or more second coupling pins 216 may not be uniformly spaced. In addition, one or more shear pins 218 (e.g., one, two, three, four, five, six, seven, eight, nine, ten, or more shear pins 218) may also extend into both the first sleeve 168 and the second sleeve 170, such that rotation of the first sleeve 168 drives rotation of the second sleeve 170 until the one or more shear pins 218 shear (e.g., break). The one or more shear pins 218 may be uniformly spaced circumferentially along the first sleeve 168 and the second sleeve 170, or in other embodiments, the one or more shear pins 218 may not be uniformly spaced about the first sleeve 168 and the second sleeve 170.

In any case, when the one or more shear pins 218 shear, rotation of the first sleeve 168 may not drive rotation of the second sleeve 170 (e.g., rotation of the first sleeve 168 is independent of the second sleeve 170). Regardless of whether the one or more shear pins 218 are intact or sheared, movement of the first sleeve 168 in the axial direction 112 (e.g., driven by rotation of the body 160) drives movement of the second sleeve 170 in the axial direction 112 as a result of the one or more second coupling pins 216. The one or more second coupling pins 216 may each extend through an opening or slot 220 of the second sleeve 170 and into a groove 222 (e.g., annular groove) of the first sleeve 168. Accordingly, while in some cases the first sleeve 168 may rotate independent of the second sleeve 170 (e.g., the one or more second coupling pins 216 move circumferentially along the groove 222), movement of the first sleeve 168 in the axial direction 112 drives movement of the second sleeve 170 in the axial direction 112, and vice versa.

To lock the lock ring 142 into the casing spool 22, rotation of the hanger running tool 100 may ultimately drive the second sleeve 170 to move in the axial direction 112, as represented by the arrow 208. Movement of the second sleeve 170 in the axial direction 112 may enable the second sleeve 170 to engage the push ring 146 of the hanger 26. For example, in some embodiments, the second sleeve 170 may have circumferentially spaced slots and/or teeth that are configured to engage corresponding circumferentially spaced slots and/or teeth of the push ring 146 (e.g., see FIG. 7).

Movement of the second sleeve 168 in the axial direction 112 may then drive movement of the push ring 146 in the axial direction 112 toward the lock ring 142. As shown in the illustrated embodiment of FIG. 4, the lock ring 142 may include the tapered surface 150 (e.g., an upper or first tapered surface) and the tapered surface 141 (e.g., a lower or second tapered surface). The first tapered surface 150 may be positioned above the second tapered surface 141 with respect to the axial direction 112. The tapered surface 148 of the push ring 146 may contact the first tapered surface 150 of the lock ring 142, thereby initially directing the lock ring 142 in the axial direction 112. However, the second tapered surface 141 may contact the tapered surface 144 of the preload ring 136 as the lock ring 142 moves in the axial direction 112. Accordingly, the force applied by the push ring 146 may cause the lock ring 142 to move radially outward in the radial direction 114, as shown by arrow 228. For example, forces may be applied to both tapered surfaces 150 and 141 of the lock ring 142 by the tapered surfaces 144 and 148 of the preload ring 136 and the push ring 146, respectively. The forces applied to the lock ring 142 may bias the lock ring 142 radially outward because of the angles of the tapered surfaces 141, 144, 148, and/or 150. As discussed above, in some embodiments, the angles of each of the tapered surfaces 141, 144, 148, and/or 150 may be substantially equal, such that the forces applied to the lock ring 142 are symmetric, thereby uniformly biasing the lock ring 142 radially outward. When the lock ring 142 moves radially outward, the lock ring 142 may be received in a corresponding recess (e.g., an annular recess) of the casing spool 22. When the lock ring 142 is disposed in the annular recess of the casing spool 22, relative axial movement between the casing spool 22 and the hanger 26 is restricted.

Figure 5:
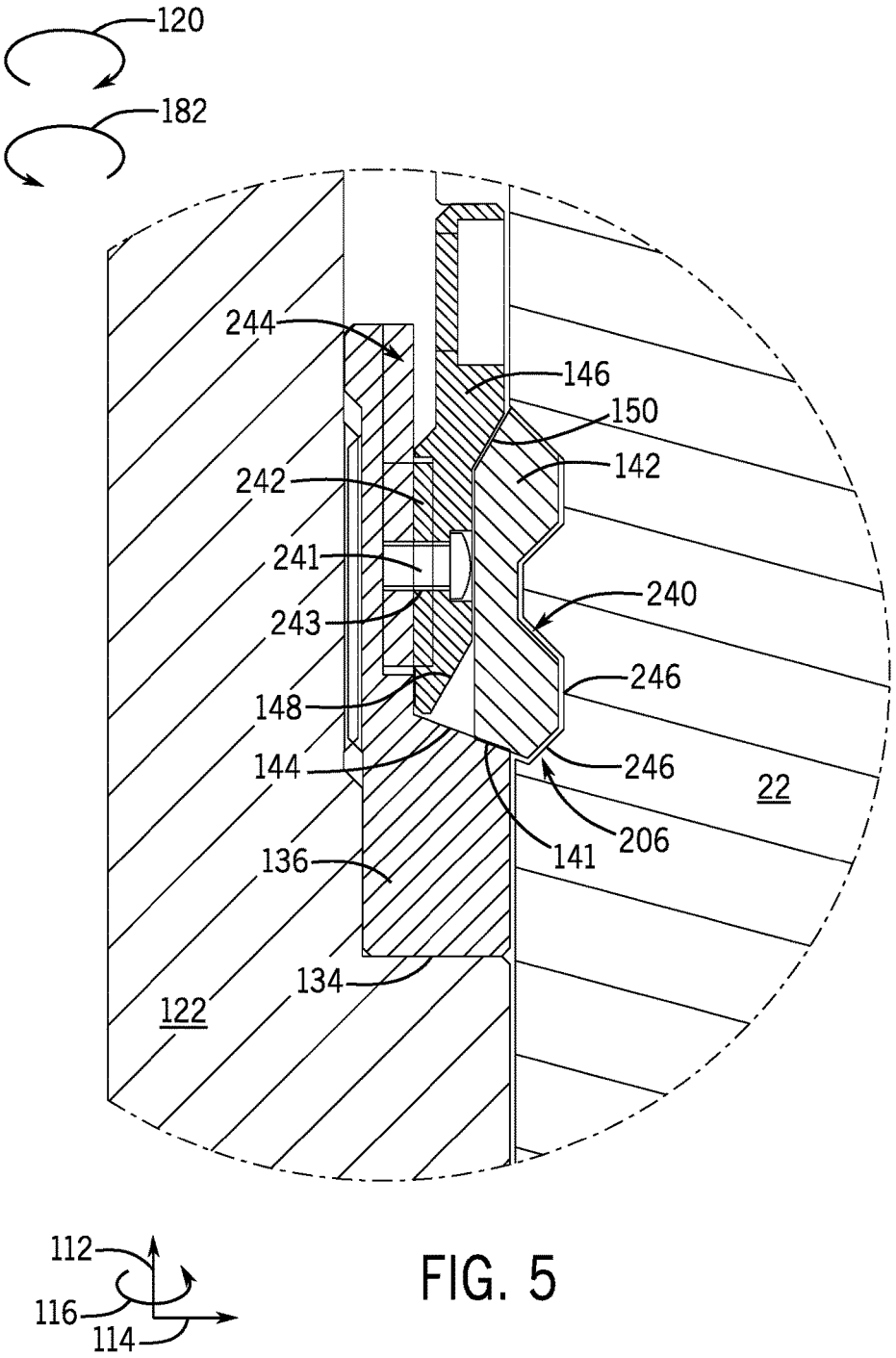
FIG. 5 is an expanded, side cross-section view of the lock ring of FIG. 4 in the locked position, in accordance with an aspect of the present disclosure.

For example, FIG. 5 is an expanded cross section view of the lock ring 142 disposed in a recess 240 of the casing spool 22. As shown in the illustrated embodiment of FIG. 5, the push ring 146 may be coupled to one or more keys 242 (e.g., axial guide keys) configured to slide in one or more grooves 244 (e.g., axial guide grooves) of the preload ring 136 as the push ring 146 moves in the axial direction 112. The push ring 146 may be coupled to the one or more keys 242 by one or more fasteners 241 disposed in a bore 243 extending through the push ring 146 and into the one or more keys 242. The push ring 146 may be configured to be disposed between the preload ring 136 and the lock ring 142 as the push ring 146 moves in the axial direction 112 (e.g., thereby directing the lock ring 142 radially outward). In some embodiments, the push ring 146 may at least partially conform to the lock ring 142, such that the push ring 146 holds the lock ring 142 in the recess 240 of the casing spool 22.

When the lock ring 142 contacts a surface 246 of the recess 240, the hanger running tool 100 may not rotate in the first circumferential direction 120 because of resistance created by contact between the lock ring 142 and the surface 246 of the recess 240. In other words, the lock ring 142 may be blocked from moving radially outward and/or in the axial direction 112 by the recess 240. Therefore, the hanger running tool 100 may not drive the first sleeve 168 and/or the second sleeve 170 further downward in the axial direction 112 via rotation that further engages the threads 102 of the hanger running tool and the threads 106 of the hanger 26. As a result, resistance may be sensed in the hanger running tool 100 via one or more sensors (e.g., piezoelectric sensors, force sensors, or another suitable sensor). In some embodiments, an operator of the hanger running tool 100 may be alerted that the lock ring 142 is in the locked position 206 when the hanger running tool 100 resists rotation in the first circumferential direction 120 and/or when the one or more sensors indicate that the hanger running tool 100 resists rotation. When the lock ring 142 is in the locked position 206, the hanger running tool 100 may be rotated in the second circumferential direction 182 to preload the lock ring 142 in the recess 240.

Figure 6:
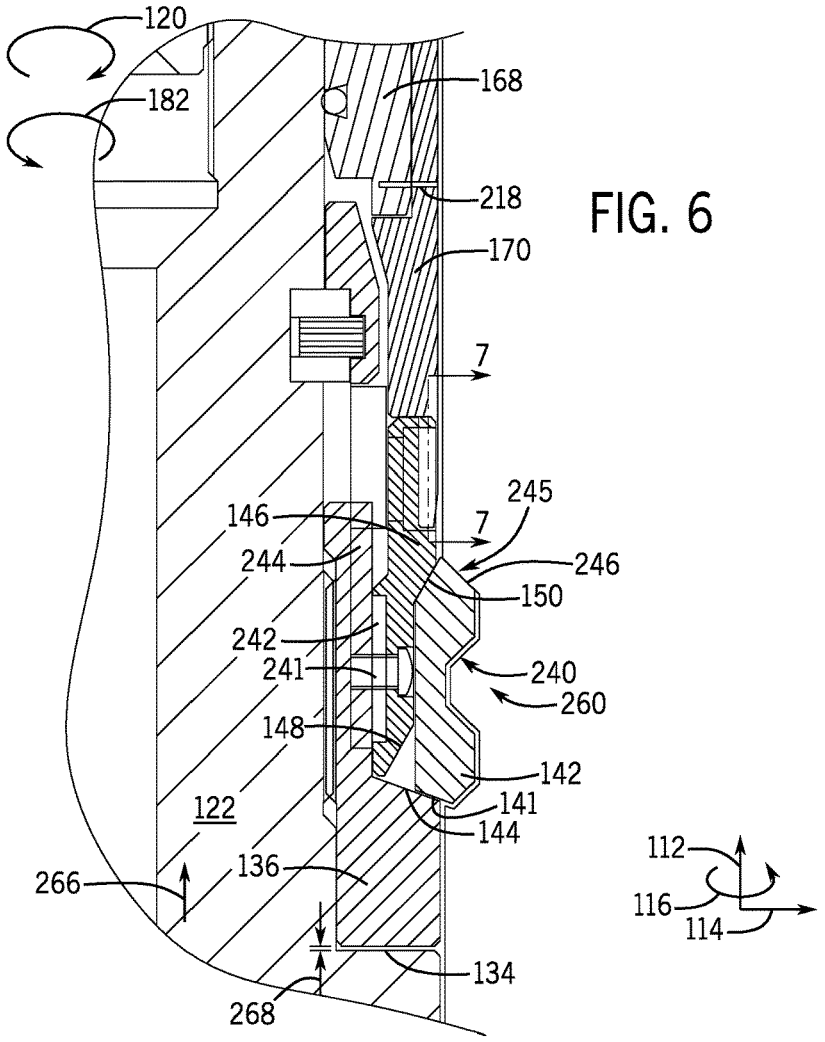
FIG. 6 is an expanded, side cross-section view of a second sleeve of the hanger running tool coupled to a push pin of the hanger, in accordance with an aspect of the present disclosure.
Figure 7:
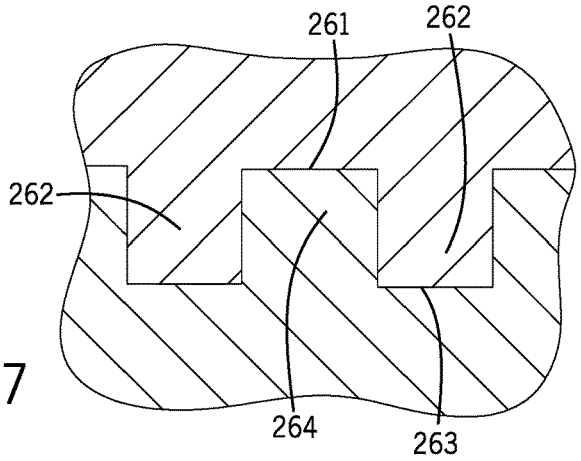
FIG. 7 is a cross section of an interface between the second sleeve and the push pin of FIG. 6, in accordance with an aspect of the present disclosure.

FIG. 6 is an expanded cross section view of the lock ring 142 when in a preloaded position 260. As discussed above, when the hanger running tool 100 rotates in the second circumferential direction 182, the first sleeve 168 and the second sleeve 170 may rotate with the body 160 of the hanger running tool 100 because the one or more pins 180 block rotation of the body 160 with respect to the first sleeve 168 (e.g., rotation of the first sleeve 168 is driven by the body 160). Rotation of the second sleeve 170 may be driven by the first sleeve 168 because of the one or more shear pins 218 that couple the first sleeve 168 and the second sleeve 170 to one another. In turn, as shown in FIG. 7, rotation of the second sleeve 170 drives rotation of the push ring 146 because circumferentially spaced slots 261 and teeth 262 of the second sleeve 170 mesh with circumferentially spaces slots 263 and teeth 264 of the push ring 146. Accordingly, the push ring 146 rotates in the second circumferential direction 182 as the second sleeve 170 rotates in the second circumferential direction 182. Additionally, the one or more keys 242 may also rotate in the second circumferential direction 182 as a result of being coupled to the push ring 146 via the one or more fasteners 241. Further, because each key 242 (e.g., axial guide key) is disposed in a corresponding groove 244 (e.g., axial guide groove) of the preload ring 136, rotation of the key 242 in the second circumferential direction 182 drives rotation of the preload ring 136 in the second circumferential direction 182. In other words, the engagement of the one or more keys 242 and the one or more grooves 244 enables torque transfer between the push ring 146 and the preload ring 136.

As shown in the illustrated embodiment of FIG. 6, rotation of the preload ring 136 in the second circumferential direction 182 may partially unthread the preload ring 136 from the hanger body 122, thereby causing the preload ring 136 to move upward in the axial direction 112, as shown by arrow 266. Thus, a gap 268 (e.g., an axial gap) may form between the preload ring 136 and the lip 134 of the hanger body 122. Additionally, movement of the preload ring 136 in the upward axial direction 112 may drive movement of the key 242, the push ring 146, and/or the lock ring 142 in the upward axial direction 112. Accordingly, a first lock surface 245 (e.g., tapered annular lock surface) of the lock ring 142 contacts the surface 246 (e.g., axially upper or top tapered annular surface) of the recess 240, while a second lock surface 247 (e.g., tapered annular lock surface) of the lock ring 142 contacts the lip 144 of the preload ring 136. In this manner, the lock ring 142 is axially squeezed or compressed between the surface 246 of the recess 240 and the lip 144 of the preload ring 136, thereby providing positive contact on the top and bottom surfaces 245 and 247 of the lock ring. Upon contacting the surface 246, the lock ring 142 cannot be driven any further in the axial direction 266, thereby blocking rotation of the preload ring 136, the key 242, the push ring 146, and/or the second sleeve 170. Accordingly, the lock ring 142 may be in the preload position 260. The second sleeve may resist rotation in the second circumferential direction 182 when the lock ring 142 reaches the preload position 260, which may then cause the one or more shear pins 218 to shear 218.

Figure 8:
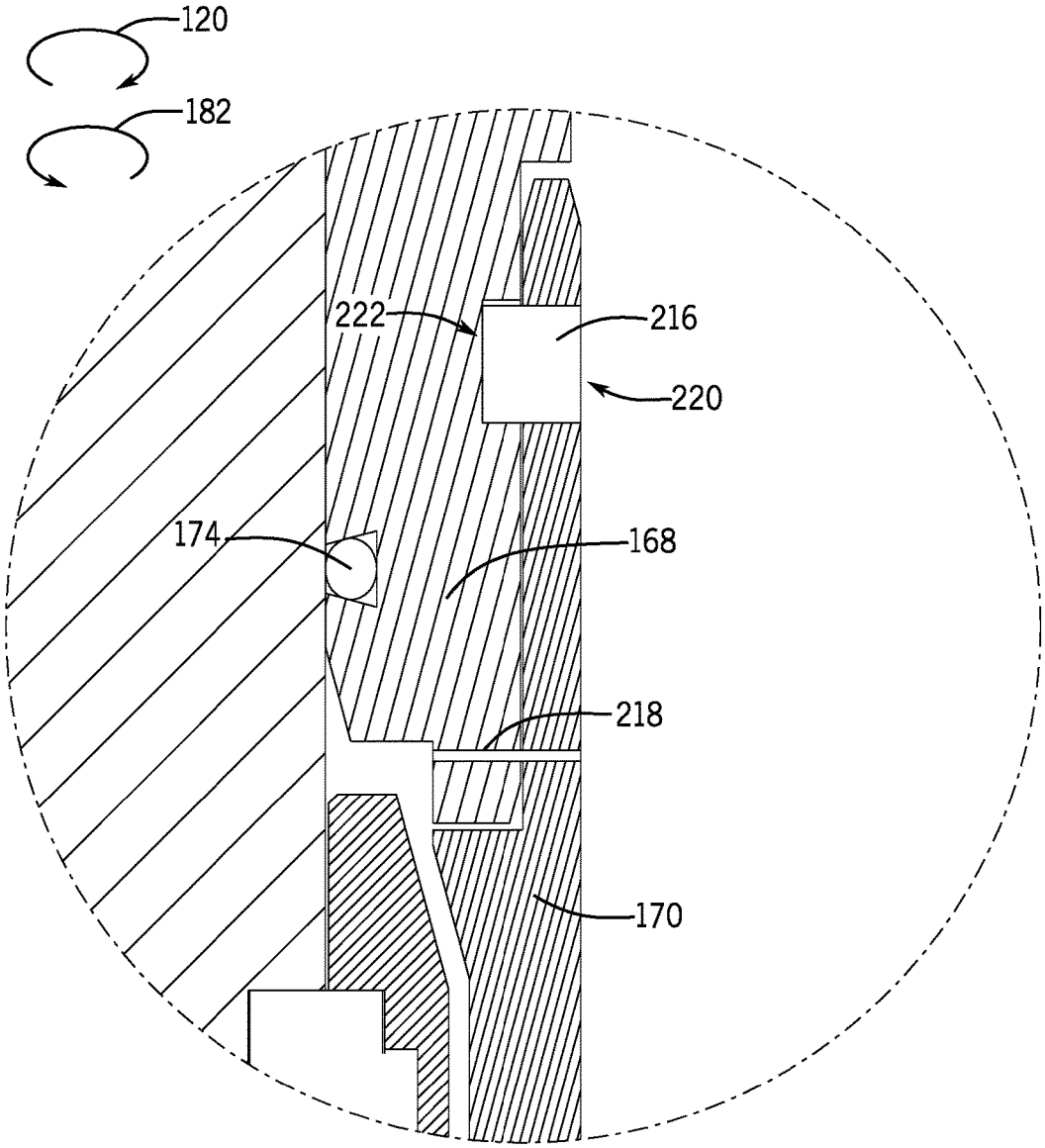
FIG. 8 is an expanded, side cross-section view of a shearing pin coupling the second sleeve of the hanger running tool to a first sleeve of the hanger running tool, in accordance with an aspect of the present disclosure.

For example, FIG. 8 is an expanded cross section view of one of the shear pins 218 coupling the first sleeve 168 and the second sleeve 170. When the lock ring 142 reaches the preload position 260, the second sleeve 170 may be blocked from rotating with the hanger running tool 100 as a result of the teeth 262 of the second sleeve 170 engaged with the teeth 264 of the push ring 146. Therefore, the one or more shear pins 218 may shear, which may enable the body 160 and the first sleeve 168 to continue rotating in the second circumferential direction 182. Ultimately, the threads 102 of the hanger running tool 100 (e.g., on the body 160 of the hanger running tool 100) will uncouple from the threads 106 of the hanger 26, thereby decoupling the hanger running tool 100 from the hanger 26. When the threads 102 of the hanger running tool 100 are uncoupled from the threads 106 of the hanger 26, the hanger running tool 100 (e.g., the body 160, the first sleeve 168, and the second sleeve 170) may be directed in the axial direction 112 toward the rig platform and removed from the well 16.

Figure 9:
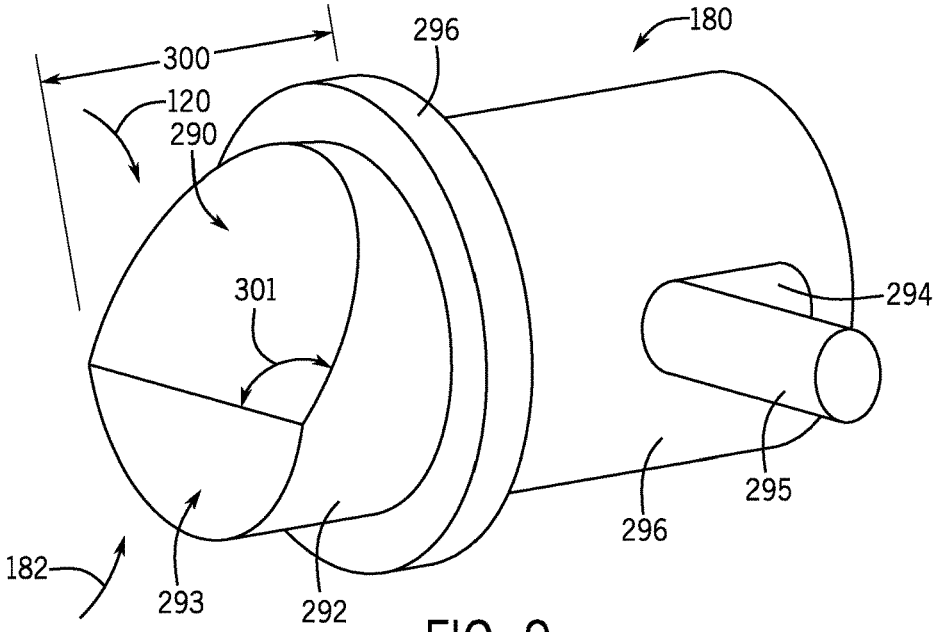
FIG. 9 is a perspective view of a pin that is disposed in between a body of the hanger running tool and the first sleeve of the hanger running tool, in accordance with an aspect of the present disclosure.
Figure 10:
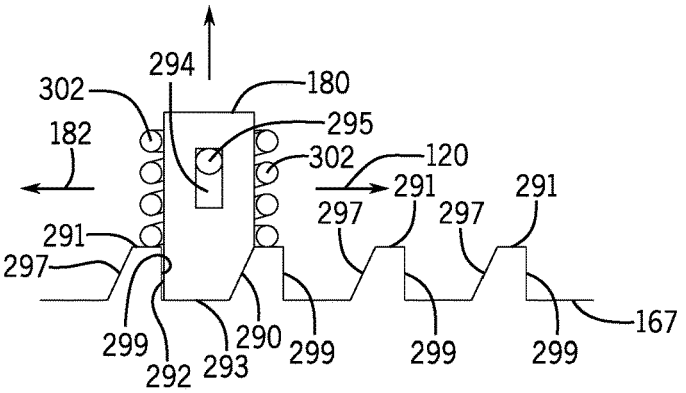
FIG. 10 is a schematic of indentations disposed circumferentially along a surface of the body and the pin of FIG. 9 in a first position, in accordance with an aspect of the present disclosure.
Figure 11:
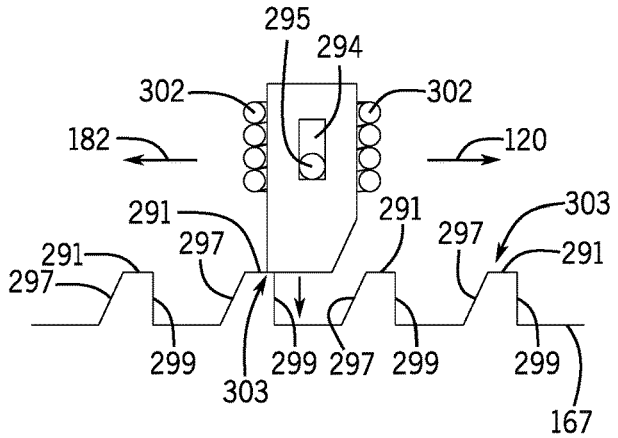
FIG. 11 is a schematic of the indentations disposed circumferentially along the surface of the body and the pin of FIG. 9 in a second position, in accordance with an aspect of the present disclosure.

FIG. 9 is an expanded perspective view of one of the pins 180 that may be disposed in the body 160 and the first sleeve 168 of the hanger running tool 100. As shown in the illustrated embodiment of FIG. 9, the pin 180 includes a tapered surface 290 that facilitates rotation of the body 160 in the first circumferential direction 120 with respect to the first sleeve 168. For example, as shown in FIGS. 10 and 11, the body 160 may include a plurality of indentations 291 that are configured to receive the one or more pins 180. The one or more pins 180 may be configured to move in and out of the plurality of indentations 291 because the tapered surface 290 of the one or more pins 180 may enable the one or more pins 180 to slide out of the plurality of indentations as the hanger running tool 100 rotates in the first circumferential direction 120. In some embodiments, the plurality of indentations 291 may each include a tapered surface 297 that further facilitates movement of the one or more pins 180 into and out of the plurality of indentations 291 when the hanger running tool 100 rotates in the first circumferential direction 120. For example, the tapered surfaces 297 of the plurality of indentations 291 may be positioned such that the tapered surface 290 of the one or more pins 280 slides along the tapered surfaces 297 when the hanger running tool 100 rotates in the first circumferential direction 120, but not the second circumferential direction 182. Thus, the body 160 may rotate within the first sleeve 168 because the tapered surface 290 of the one or more pins 180 slides along the indentations 291 of the body 160.

However, the pin 180 also includes a tip portion 293 and a second surface 292 (e.g., a non-tapered surface or perpendicular surface) that blocks rotation of the body 160 in the second circumferential direction 182 with respect to the first sleeve 168. For example, as shown in FIGS. 10 and 11, the one or more pins 180 may be blocked from moving into and out of (e.g., along) the indentations 291 on the body 160 of the hanger running tool 100 because the tip portion 293 may abut a substantially perpendicular surface 299 of the plurality of indentations 291. Accordingly, when the hanger running tool 100 rotates in the second circumferential direction 182, a respective one of the plurality of indentations 291 blocks the one or more pins 180 from moving along the external surface 167 of the body 160. Therefore, the body 160 may rotate in the first circumferential direction 120 independent of the first sleeve 168, but when the body 160 rotates in the second circumferential direction 182, the first sleeve 168 also rotates in the second circumferential direction 182 because the one or more pins 180 are blocked from moving in and out of the plurality of indentations 291.

In some embodiments, the tapered surface 290 may form an acute angle 301 with the second surface 293, which may be configured to facilitate rotation of the body 160 in the first circumferential direction 120. In some embodiments, the angle 301 may be between 30 and 70 degrees, between 40 and 50 degrees, or between 43 and 47 degrees. In other embodiments, the angle may be approximately (e.g., within 5% or within 10%) 45 degrees.

Additionally, in some embodiments, each pin 180 may include an elongated slot 294 that holds the pin 180 in position between the body 160 and the first sleeve 160. The slot 294 may be positioned along a body 296 of the pin 180. When a fastener 295 is disposed in the slot 294, the tapered surface 290 may be substantially aligned with the indentations 291 to facilitate rotation of the body 160 with respect to the first sleeve 160. Moreover, each pin 180 may include a spring 302 (see, e.g., FIGS. 10 and 11) that is configured to bias the pin 180 toward the indentations 291. Accordingly, when the pin 180 reaches a top portion 303 (e.g., FIG. 11) of a respective indentation 291, the pin 180 may be directed into an adjacent indentation 291 as a result of movement of the body 160 in the first circumferential direction 120 and a biasing force applied by the spring. In some embodiments, the fastener 295 may move within the slot 294 as the pin 180 moves along the indentations 291.

The pin 180 may also include a collar 296 that further positions the pin 180 in a suitable position within the hanger running tool 100. For example, the pin 180 may extend into the body 160 a distance that corresponds to a distance 300 between the second surface 293 and the collar 296. The distance 300 may be predetermined to ensure that the tapered surface 290 will slide along the threads 176 of the body 160 without substantial resistance. In some embodiments, the collar 296 may also block the pin 180 from extending further out of the body 160 and thus reduce any forces applied to the fastener 295 disposed in the slot 294.

Figure 12:
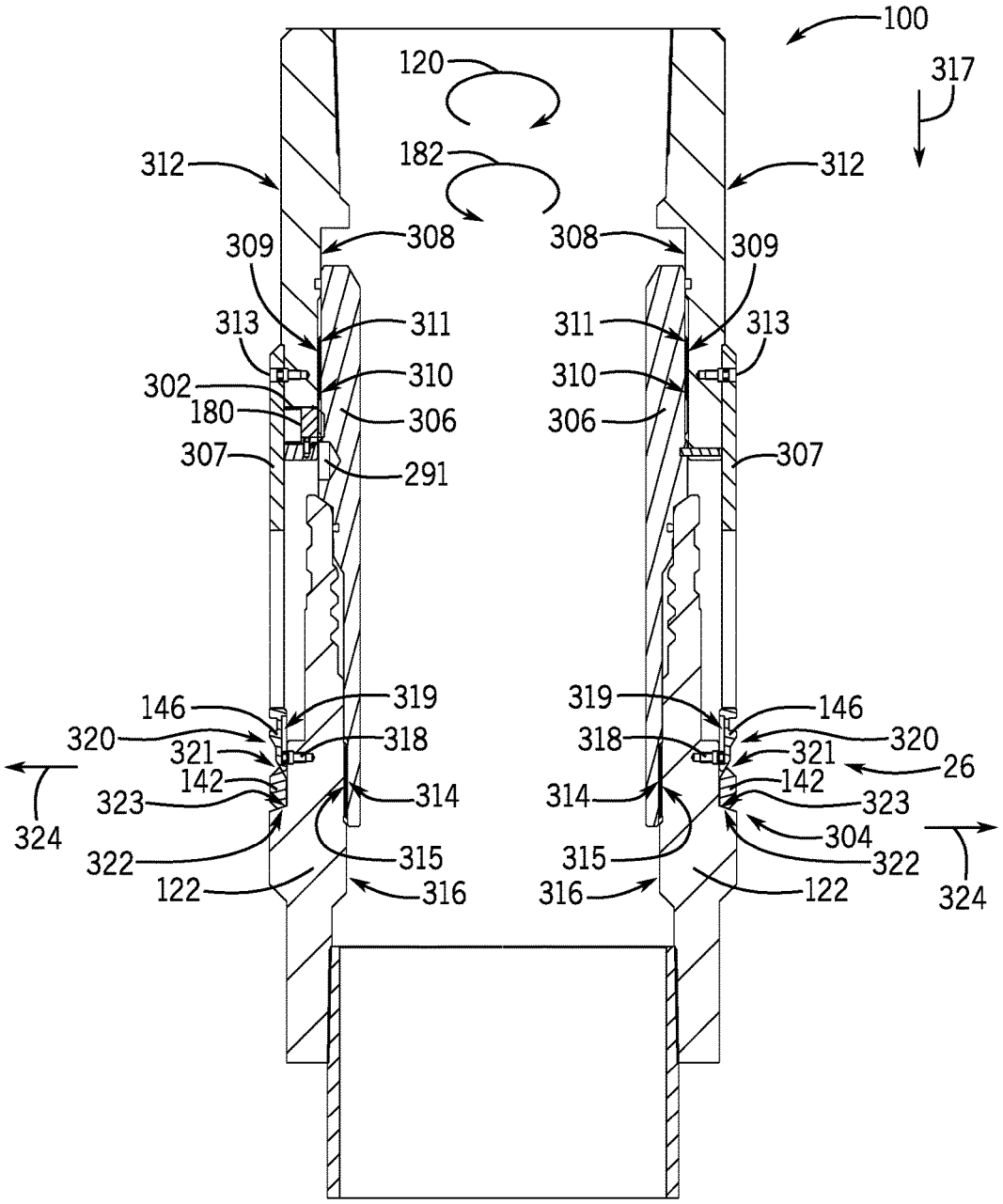
FIG. 12 is a side cross-section view of another embodiment of the hanger running tool and the hanger when the lock ring is in an unlocked position, in accordance with an aspect of the present disclosure.

FIG. 12 is a side cross-section view of an embodiment of the hanger running tool 100 and the hanger 26 when the lock ring 142 is in an unlocked position 304. As shown in the illustrated embodiment of FIG. 12, the hanger 26 does not include the preload ring 136. Accordingly, the embodiment of the hanger running tool 100 and the hanger 26 shown in FIG. 12 may move the lock ring 142 from an unlocked position 304 to a locked position 305 (see FIG. 13), but may not preload the lock ring 142.

The hanger running tool 100 may include the body 160 (e.g., an annular body) coupled to a first sleeve 306 (e.g., an inner sleeve) and a second sleeve 307 (e.g., an outer sleeve). The first sleeve 306 may be coupled to and proximate an inner surface 308 of the body 160 via threads 309 on the inner surface 308 of the body 160 and corresponding threads 310 on the outer surface 311 of the first sleeve 306. The pin 180 may be disposed between the first sleeve 306 and the body 160. As discussed in detail above, the pin 180 may enable rotation of the body 160 independent of the first sleeve 306 (e.g., the first sleeve 306 does not rotate) in the first circumferential direction 120 and block rotation of the body 160 independent of the first sleeve 306 (e.g., the first sleeve does rotate) in the second circumferential direction 182.

As shown in the illustrated embodiment of FIG. 12, the pin 180 may be positioned in the body 160, and the indentations 291 may be disposed on the outer surface 311 of the first sleeve 306. When the lock ring 142 is in the unlocked position 304, the pin 180 may be positioned above the indentations 291 with respect to the axial direction 112. Accordingly, the pin 180 does not block rotation of the body 160 independent of the first sleeve 306 until the body 160 moves in the axial direction and the pin 180 engages the indentations 291 (see, e.g., FIGS. 10 and 11). Additionally, the second sleeve 307 may be coupled to and proximate an outer surface 312 of the body 160 by a coupling pin 313. Further, the first sleeve 306 may be coupled to the hanger 26 via second threads 314 disposed on the outer surface 311 of the first sleeve 306 and threads 315 on an inner surface 316 of the hanger 26.

Figure 13:
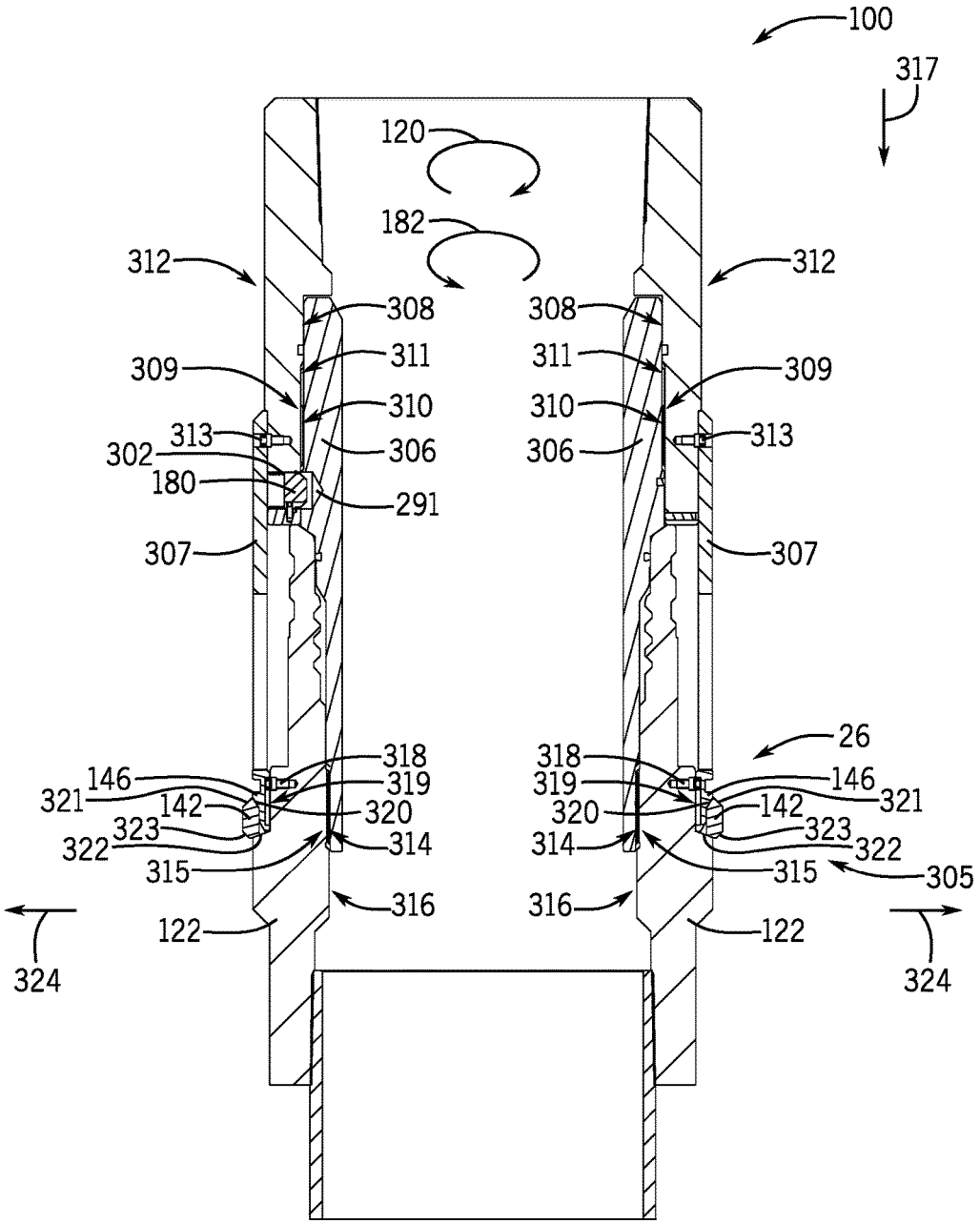
FIG. 13 is a side cross-section view of the hanger running tool and the hanger of FIG. 12 when the lock ring is in a locked position, in accordance with an aspect of the present disclosure.

As shown in the illustrated embodiment of FIG. 13, when the body 160 moves in the first circumferential direction 120, the body 160 moves in the axial direction 112, as represented by arrow 317. The body 160 may also drive movement of the second sleeve 307 in the axial direction 112 (represented by the arrow 317) via the coupling pin 313 that extends into both the body 160 and the second sleeve 307. However, the first sleeve 306 may not move in the axial direction 112 with the body 160 and the second sleeve 307. Rather, the threads 309 of the body 160 may move further along a length of the threads 310 of the first sleeve 306, thereby substantially maintaining a position of the first sleeve 306 with respect to the axial direction 112. Additionally, the threads 314 of the first sleeve 306 may not move with respect to the threads 315 on the inner surface of the hanger 26 (e.g., the position of the first sleeve 306 and the hanger 26 with respect to one another is substantially maintained) because the first sleeve 306 is not rotating in the first circumferential direction 120. In some embodiments, rotation of the first sleeve 306 with respect to rotation of the body 160 may be blocked (e.g., via a pin or another device). In other embodiments, the first sleeve 306 may experience some rotation as the body 160 rotates (e.g., as a result of friction between the threads 314 and the threads 315).

The movement of the second sleeve 307 in the axial direction 112 may drive movement of the push ring 146 of the hanger 26 in the axial direction 112. In some embodiments, the second sleeve 307 may engage with the push ring 146 as discussed above with reference to FIG. 7. However, in some embodiments, the second sleeve 307 may simply contact a surface of the push ring 146 to move the push ring 146 in the axial direction 112. In any case, the push ring 146 may be coupled to an alignment pin 318 (e.g., axial guide pin), which may be configured to slide within a groove 319 (e.g., axial guide slot) of the push ring 146. Accordingly, the push ring 146 may be axially aligned with the body 122 of the hanger 26 as the push ring 146 moves in the axial direction 112. The push ring 146 includes a tapered surface 320 (e.g., tapered annular surface) that engages a first tapered surface 321 (e.g., tapered annular surface) of the lock ring 142. The body 122 of the hanger 26 may also include a tapered surface 322 (e.g., tapered annular surface) that engages with a second tapered surface 323 (e.g., tapered annular surface) of the lock ring 142. The force of the tapered surfaces 320 and 322 on the tapered surfaces 321 and 323 of the lock ring 142 drive the lock ring 142 in the radial direction 114 toward the recess 240 of the casing spool 22, as represented by arrow 324. The tapered surface 320 of the push ring 146 then applies a force to the lock ring 142 that holds the lock ring 142 in the recess 240. As discussed above, the lock ring 142 may be biased toward the body 122 of the hanger 26. Accordingly, the push ring 146 may conform to a shape of the lock ring 142 to apply the force to the lock ring 142 and hold the lock ring 142 in the recess 240.

Additionally, as the body 160 moves in the axial direction (as represented by the arrow 317), the pin 180 engages the indentations 291 in the first sleeve 306. As discussed above, the pin 180 may include the spring 302 that biases the pin 180 toward the first sleeve 306. Accordingly, when the body 160 moves in the axial direction 112, such that the pin 180 is aligned with one of the indentations 291, the pin 180 may be spring biased into the indentation 291.

When the lock ring 142 reaches the locked position 305, the hanger running tool may incur resistance to rotation in the first circumferential direction 120, because the push ring 146 may contact the tapered surface 322 of the hanger 26, such that movement of the second sleeve 307 and the body 160 in the axial direction 112 is blocked. Accordingly, movement of the second sleeve 307 and the body 160 in the first circumferential direction 120 may also be blocked. Accordingly, the operator (or a sensor) may determine that the lock ring 142 is in the locked position 305 upon incurring (or sensing) the resistance of the hanger running tool 100 to rotation in the first circumferential direction.

Figure 14:
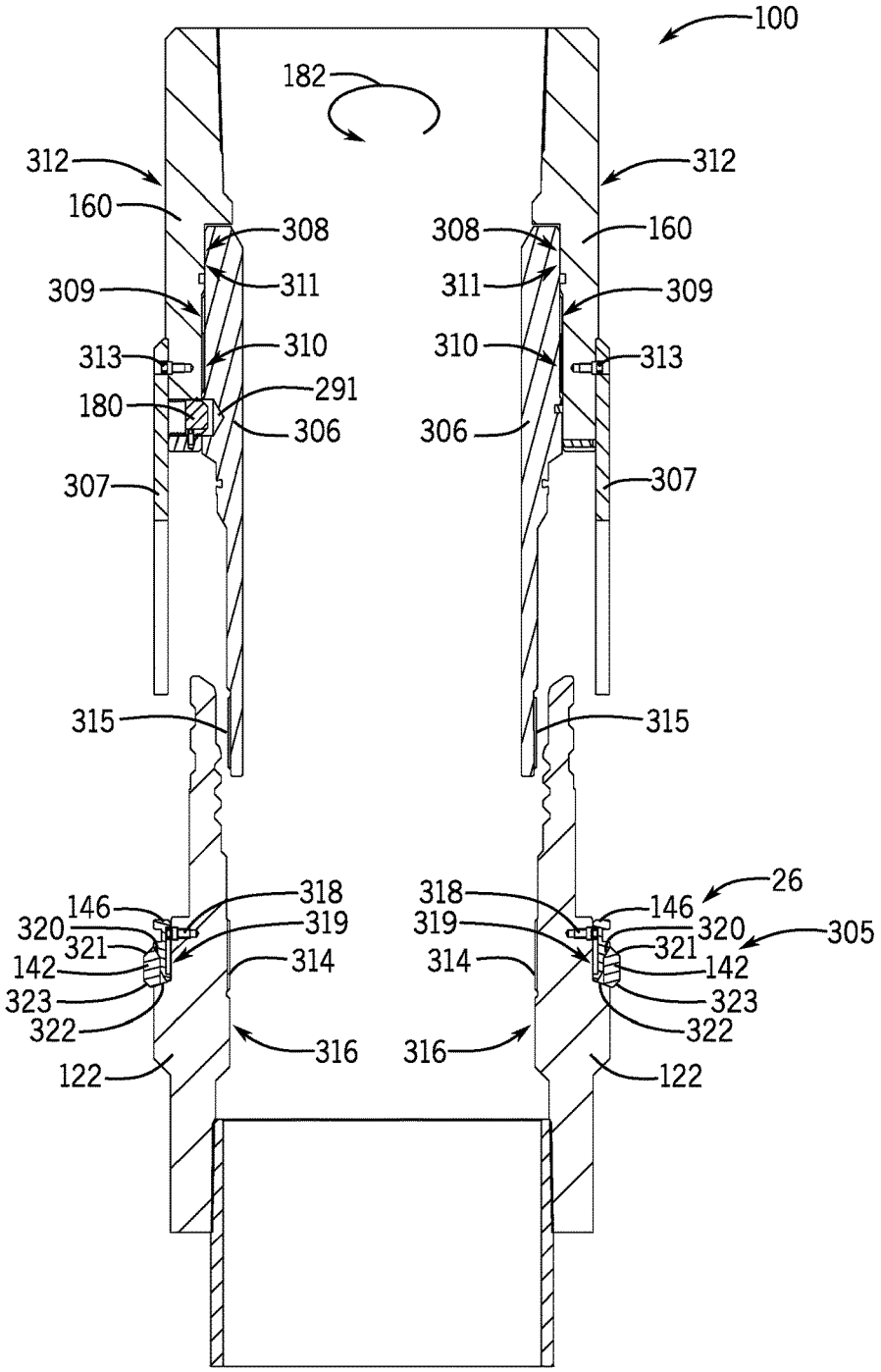
FIG. 14 is a side cross-section view of the hanger running tool removed from the hanger of FIGS. 12 and 13, in accordance with an aspect of the present disclosure.

The hanger running tool 100 may then be rotated in the second circumferential direction 182 to remove the hanger running tool 100 from the hanger 26. As discussed above, the pin 180 may block rotation of the body 160 with respect to the first sleeve 306 in the second circumferential direction 182, such that the first sleeve 306 rotates in the second circumferential direction 182 with the body 160. Accordingly, the threads 314 of the first sleeve 306 may unthread (e.g., decouple) from the threads 315 of the hanger 26. Ultimately, the threads 314 of the first sleeve 306 are completely removed from the threads 315 of the hanger 26, such that the hanger running tool 100 may be removed, as shown in FIG. 14.

Figure 15:
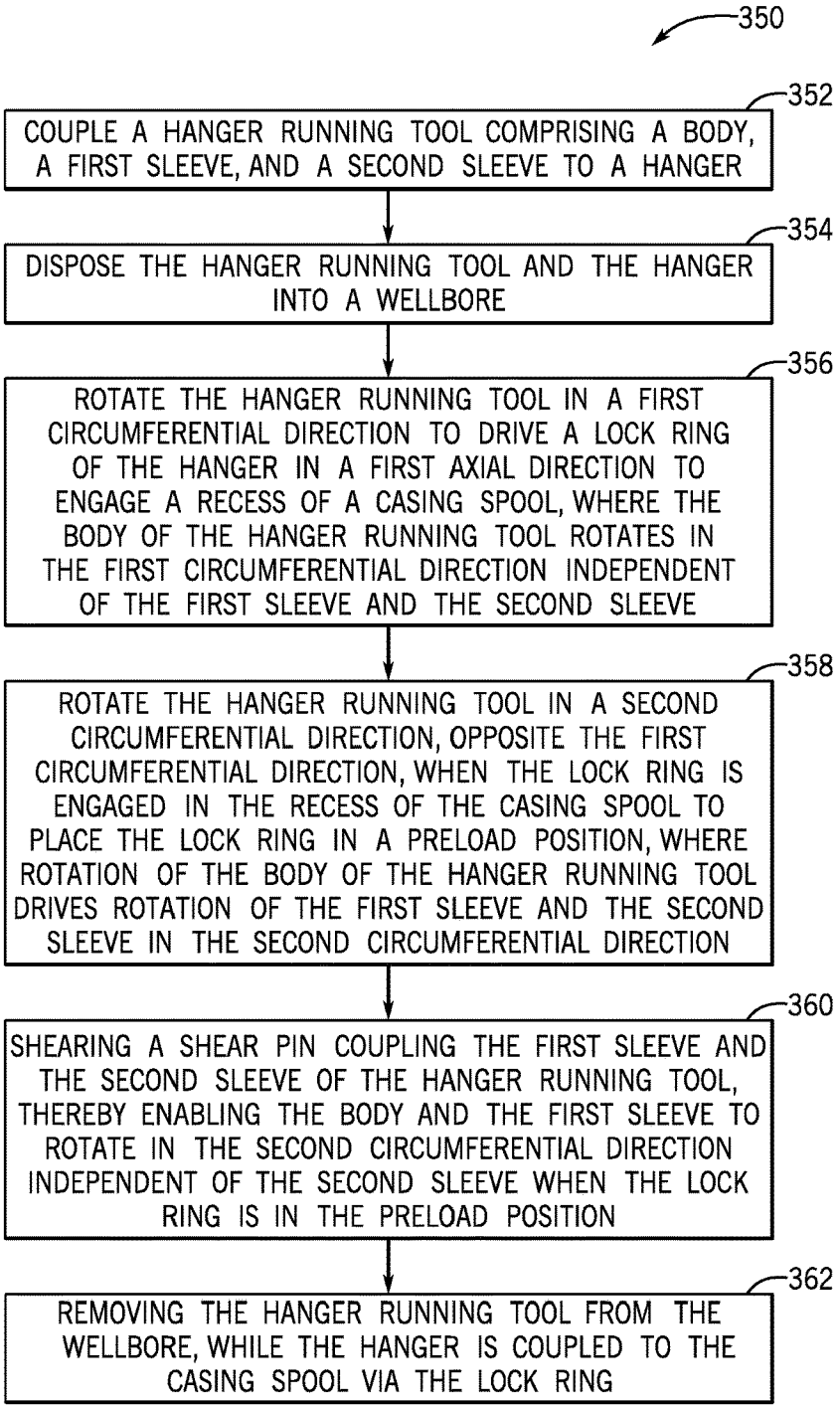
FIG. 15 is a block diagram of a process that may be used to couple the hanger of FIG. 2 to a casing spool, in accordance with an aspect of the present disclosure.

FIG. 15 is a block diagram of a process 350 that may be utilized to lock the lock ring 142 in the casing spool 22, preload the lock ring 142 in the casing spool 22, and remove the hanger running tool 100 from the hanger 26 in a single trip. For example, at block 352, the hanger running tool 100 may be coupled to the hanger 26 by meshing the threads 102 of the hanger running tool 100 with the threads 106 of the hanger 26 (e.g., rotating the body 160 of the hanger running tool 100 so that hanger running tool 100 screws into the hanger 26). Additionally, at block 354, the hanger running tool 100 and the hanger 26 may be disposed into the well 16 by moving the hanger running tool 100 and the hanger 26 in the axial direction 112 along the well 16 (e.g., via the drive 37). When the hanger 26 reaches the shoulder 36 of the casing spool 22, further movement of the hanger running tool 100 and the hanger 26 in the axial direction 112 may be blocked. Accordingly, an operator may understand that the hanger 26 is in position with respect to the casing spool 22 when the hanger running tool 100 and the hanger 26 no longer move in the axial direction 112 or when a sensor indicates that the hanger running tool 100 encounters resistance above a threshold level.

At block 356, the hanger running tool 100 may be rotated in the first circumferential direction 120 (e.g., by the drive 37), thereby directing the first sleeve 168, the second sleeve 170, the push ring 146, the key 242, and/or the lock ring 142 in the axial direction 112. When the lock ring 142 contacts the preload ring 136, the lock ring 142 may be directed in the radial direction 114 toward the recess 240 of the casing spool 22 as a result of the inward tapered exterior surface 148 of the push ring 146. As discussed above, the pin 180 may enable rotation of the body 160 of the hanger running tool 100 independent of the first sleeve 168 and the second sleeve 170. For example, the body 160 may rotate in the first circumferential direction 120 while the first sleeve 168 and the second sleeve 170 remain substantially stationary with respect to rotation about the central axis 118. However, as the body 160 rotates in the first circumferential direction 120, the body 160 may move in the axial direction 112, thereby driving movement of the first sleeve 168 and the second sleeve 170 in the axial direction 112 (e.g., via the coupling pins 181 and 216). In turn, the second sleeve 168 may contact the push ring 146, which may then drive movement of the lock ring 142 in the axial direction 112 and the radial direction 114 as the body 160 rotates in the first circumferential direction 120.

Eventually, the lock ring 142 may engage with the surface 246 of the recess 240, which may block any further movement of the hanger running tool 100 and/or the hanger 26 in the axial direction 112. Therefore, an operator may know when the lock ring 142 is in the recess 240 upon resistance to rotation of the hanger running tool 100 in the first circumferential direction 120 (or when a sensor indicates that the hanger running tool 100 experiences resistance above a threshold). Accordingly, at block 358, the hanger running tool 100 may be rotated in the second circumferential direction 182 (e.g., by the drive 37), opposite the first circumferential direction 120. As discussed above, rotation of the hanger running tool 100 in the second circumferential direction 182 may ultimately drive rotation of the preload ring 136. For example, the pin 180 of the hanger running tool 100 may block rotation of the body 160 with respect to the first sleeve 168, such that the first sleeve 168 rotates with the body 160 in the second circumferential direction 182. Additionally, the first sleeve 168 is coupled to the second sleeve 170, and thus, the second sleeve 170 also rotates in the second circumferential direction 182 with the body 160 and the first sleeve 168. The teeth 262 of the second sleeve 170 may engage with the teeth 264 of the push ring 146, thereby causing the push ring 146 to rotate in the second circumferential direction 182. Further, the push ring 146 may be engaged with the key 242, which may be disposed in the groove 244 of the preload ring 136. Therefore, rotation of the push ring 146 drives rotation of the preload ring 136 in the second circumferential direction 182. When the preload ring 136 rotates in the second circumferential direction 182, the preload ring 136 may partially unthread from the body 122 of the hanger 26, thereby directing the preload ring 136 upward in the axial direction 112.

When the preload ring 136 moves in the axial direction 112, the preload ring 136 may drive movement of the lock ring 142 in the axial direction 112 to further secure the lock ring 142 in the recess 240 of the casing spool 22. When the lock ring 142 is in the preload position 260, rotation of the preload ring 136 may be substantially restricted, thereby also restricting rotation of the key 242 and the push ring 146 in the second circumferential direction 182. When rotation of the push ring 146 is restricted in the second circumferential direction 182 and the hanger running tool 100 continues to rotate in the second circumferential direction 182, the shear pin 218 between the first sleeve 168 and the second sleeve 170 may shear, as shown in block 360.

When the shear pin 218 shears, the first sleeve 168 and the body 160 may continue to rotate in the second circumferential direction 182 independent of the second sleeve 170. Therefore, the body 160 may ultimately become decoupled from the hanger 26 as the threads 102 of the hanger running tool 100 (e.g., positioned on the body 160) are unscrewed from the threads 106 of the hanger 26.

Accordingly, at block 362, the hanger running tool 100 may be removed from the well 16 when the threads 102 of the hanger running tool 100 are uncoupled from the threads 106 of the hanger 26 by directing the hanger running tool 100 in the axial direction 112. Embodiments of the hanger running tool 100 disclosed herein may be configured to dispose the lock ring 142 of the hanger 26 in the locked position, preload the lock ring of the hanger 26 in the casing spool 22, and remove the hanger running tool 100 from the hanger 26 in a single trip into the well 16.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a hanger running tool, comprising:

a tool body;

a first sleeve coupled to an external surface of the tool body;

a second sleeve coupled to the first sleeve, wherein the second sleeve is configured to engage a push ring of a hanger to drive a lock ring of the hanger into a recess of a casing spool; and a pin disposed in the tool body and the first sleeve, wherein the pin is configured to enable rotation of the tool body independent of the first sleeve in a first circumferential direction, and wherein the pin is configured to block rotation of the tool body independent of the first sleeve in a second circumferential direction, opposite the first circumferential direction.

2. The system of claim 1, wherein the hanger running tool is configured to run and lock the hanger into the casing spool in a single trip.

3. The system of claim 1, wherein the pin comprises a tapered surface configured to engage with a plurality of indentations of the tool body, which enables the tool body to rotate in the first circumferential direction.

4. The system of claim 3, wherein the tapered surface of the pin forms an acute angle with a second surface of the pin.

5. The system of claim 3, wherein the plurality of indentations of the tool body each comprise an additional tapered surface configured to facilitate movement of the pin into and out of the indentations.

6. The system of claim 5, wherein the plurality of indentations of the tool body each comprise a substantially perpendicular surface, and wherein a second surface of the pin is configured to abut a respective substantially perpendicular surface when the tool body rotates in the second circumferential direction, such that rotation of the tool body independent of the first sleeve is blocked.

7. The system or claim 6, wherein the second surface of the pin is substantially parallel to the respective substantially perpendicular surface of the plurality of indentations.

8. The system of claim 3, wherein the pin comprises a spring configured to bias the pin toward the indentations.

9. The system of claim 1, comprising the hanger, the hanger comprising:

a hanger body;

a preload ring disposed around an external surface of the hanger body, wherein the preload ring comprises a groove;

the lock ring configured to expand radially outward from the preload ring toward the recess of the casing spool;

the push ring configured to drive the lock ring into the recess of the casing spool; and a key coupled to the push ring, wherein the key is configured to slide in the groove of the preload ring in an axial direction.

10. The system of claim 9, wherein the second sleeve comprises first teeth and the push ring comprises second teeth, and wherein the first teeth and the second teeth are configured to engage with one another, such that rotation of the second sleeve drives rotation of the push ring.

11. The system of claim 1, wherein the first sleeve is coupled to the tool body via a coupling pin, wherein the coupling pin is configured to drive the first sleeve in an axial direction as the tool body moves in the axial direction.

12. The system of claim 1, wherein the first sleeve is coupled to the second sleeve via a coupling pin and a shear pin, wherein the coupling pin is configured to drive the second sleeve in an axial direction as the first sleeve moves in the axial direction, and wherein the shear pin is configured to shear when the lock ring is in a preload position and the hanger running tool rotates in the second circumferential direction.

13. The system of claim 12, wherein the shear pin is configured to shear to enable the hanger running tool to decouple from the hanger when the lock ring is in the preload position.

14. The system of claim 1, wherein the tool body comprises first threads on a first surface, the hanger comprises second threads on a second surface, and the first and second threads couple the tool body to the hanger.

15. A method, comprising:

rotating a hanger running tool comprising a body, a first sleeve, and a second sleeve in a first circumferential direction to drive a lock ring of a hanger in a first axial direction to engage a recess of a casing spool, wherein the body of the hanger running tool rotates in the first circumferential direction independent of the first sleeve and the second sleeve;

rotating the hanger running tool in a second circumferential direction, opposite the first circumferential direction, when the lock ring is engaged in the recess of the casing spool to place the lock ring in a preload position, wherein rotation of the body of the hanger running tool in the second circumferential direction drives rotation of the first sleeve and the second sleeve in the second circumferential direction; and shearing a shear pin coupling the first sleeve and the second sleeve of the hanger running tool, thereby enabling the body and the first sleeve to rotate in the second circumferential direction independent of the second sleeve when the lock ring is in the preload position.

16. The method of claim 15, comprising:

coupling the hanger running tool to the hanger; and disposing the hanger running tool and the hanger into a wellbore before rotating the hanger running tool.

17. The method of claim 15, comprising removing the hanger running tool from the wellbore after shearing the shear pin, wherein the hanger is coupled to the casing spool via the lock ring.

18. A system, comprising:

a hanger running tool, comprising:

a tool body;

a first sleeve coupled to an external surface of the tool body;

a second sleeve coupled to the first sleeve, wherein the second sleeve is configured to engage a push ring of a hanger to drive a lock ring of the hanger into a recess of a casing spool; and a pin disposed in the tool body and the first sleeve, wherein the pin comprises a tapered surface configured to enable rotation of the tool body independent of the first sleeve in a first circumferential direction, the pin comprises a second surface that is configured to block rotation of the tool body independent of the first sleeve in a second circumferential direction, opposite the first circumferential direction, and the pin comprises a slot configured to secure the pin in the first sleeve.

19. The system of claim 18, wherein the hanger running tool is configured to run and lock the hanger into the casing spool in a single trip.

20. The system of claim 18, wherein the tapered surface forms an acute angle with the second surface.

* * * * *